United States Patent [19]

Segebrecht et al.

[11] Patent Number: 4,632,649

[45] Date of Patent: Dec. 30, 1986

[54] GAS JET PUMP

[75] Inventors: Udo Segebrecht; Siegfried Auschrat, both of Heiligenstedten, Fed. Rep. of Germany

[73] Assignee: Sihi GmbH & Co. KG, Itzehoe, Fed. Rep. of Germany

[21] Appl. No.: 758,208

[22] Filed: Jul. 23, 1985

[30] Foreign Application Priority Data

Jul. 26, 1984 [DE] Fed. Rep. of Germany ..... 3427645

[51] Int. Cl.[4] ..... F04F 5/00

[52] U.S. Cl. ..... 417/151; 417/195

[58] Field of Search ..... 417/151, 167, 178, 195–198; 285/213, 336, 55

[56] References Cited

U.S. PATENT DOCUMENTS

| | | | |
|---|---|---|---|
| 2,085,361 | 6/1937 | Hellmer | 417/195 |
| 2,146,100 | 2/1939 | Walch | 417/151 |
| 2,178,898 | 11/1939 | Schellin et al. | 417/198 X |
| 2,183,623 | 12/1939 | Ross | 417/195 |
| 2,231,090 | 2/1941 | Ross | 417/198 X |
| 3,064,878 | 11/1962 | Bayles et al. | 417/151 X |
| 3,369,735 | 2/1968 | Hoffmeister | 417/195 X |

*Primary Examiner*—William L. Freeh
*Assistant Examiner*—Paul F. Neils
*Attorney, Agent, or Firm*—Prutzman, Kalb, Chilton & Alix

[57] ABSTRACT

A gas jet pump having a housing and a mixing nozzle holder which, in the area of their flange connection, form a mounting for a mixing nozzle. The mounting comprises on the one hand a clamping groove formed by both flanges in their parting plane, and on the other hand an annular groove in the periphery of the mixing nozzle and a ring made of elastic material located in both grooves. This secures both the axial position of the mixing nozzle relative to the housing and also the sealing.

7 Claims, 4 Drawing Figures

Fig. 1
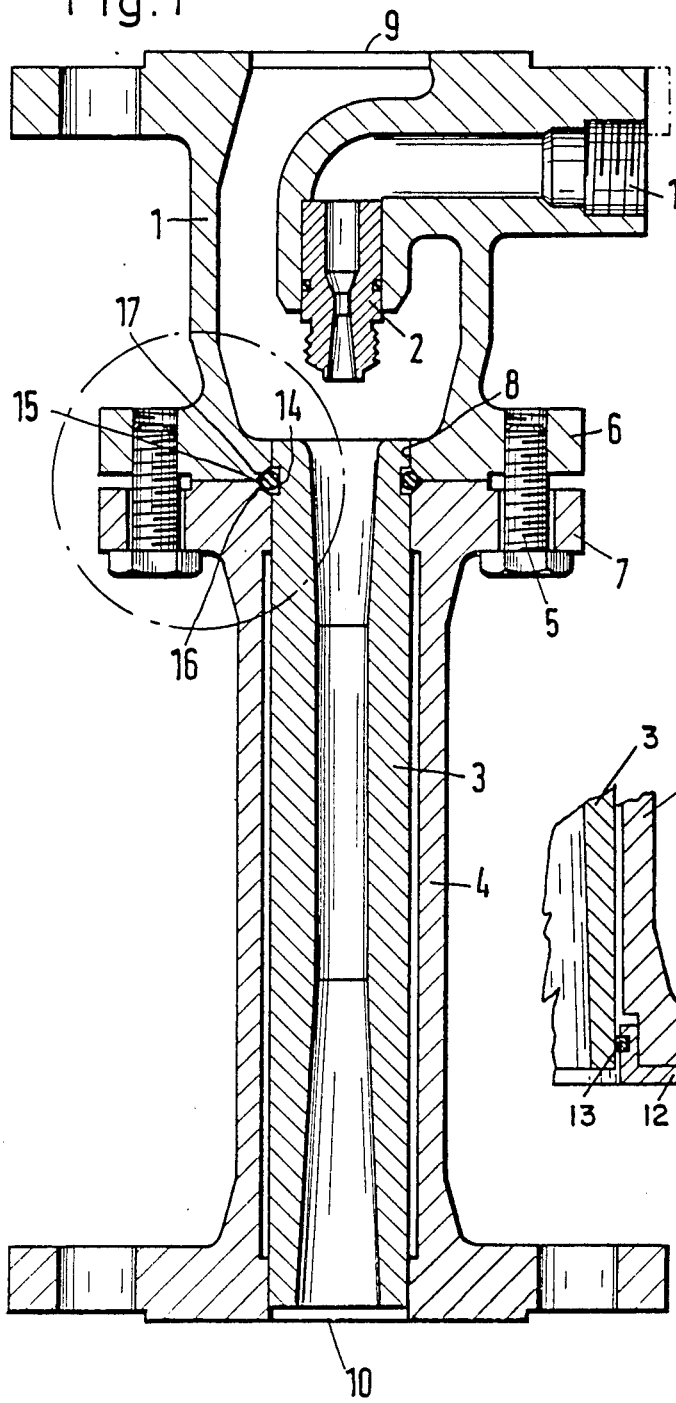
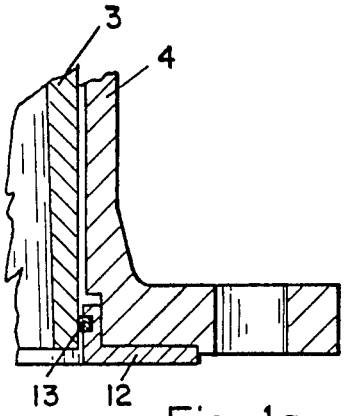
Fig. 1a

GAS JET PUMP

DESCRIPTION

The invention relates to a gas jet pump having a housing, a mixing nozzle holder, a flange connection between the housing and the mixing nozzle holder and a mixing nozzle, with a mounting being provided in the flange connection for the mixing nozzle, which mounting comprises a clamping groove formed by both flanges in their parting plane.

Such pumps are used in both the sub-atmospheric pressure range (for example, as backing pumps for other vacuum pumps) and in the above-atmospheric pressure range. The housing is to be understood as that part which encloses the fuel nozzle as well as the channels for supplying the fuel gas and the medium to be compressed. The mixing nozzle is to be connected coaxially and in sealed manner to this housing. This is known to be effected (U.S. Pat. No. 3,064,878, FIG. 6) by means of a mixing nozzle holder connected by a flange connection to the housing, with the housing and the mixing nozzle holder forming a clamping groove in the parting plane of their flanges, by means of which clamping groove they clamp an annular projection from the periphery of the mixing nozzle. The disadvantage of this embodiment is that the diameter of the annular projection determines the outside diameter of the raw material for the production of the mixing nozzle, with the outside diameter in the entire remaining mixing nozzle area outside the annular projection having to be correspondingly reduced by machining. This is expensive.

The object of the invention is to make available in a gas jet pump of the type mentioned at the beginning a less expensive mounting of the mixing nozzle in the housing and mixing nozzle holder.

The object is achieved according to the invention in that the mounting for the mixing nozzle comprises an annular groove in the periphery of the mixing nozzle and a ring made of elastic material inserted into the annular groove, which ring is enclosed under tension in the annular space formed by the annular groove and the clamping groove.

Since the annular projection can be dispensed with, raw material can be used for the mixing nozzle, the outside diameter of which raw material is only insignificantly greater than the finished-size outside diameter of the mixing nozzle. Moreover, this embodiment has the advantage that, here, a single ring made of elastic material both fixes the mixing nozzle in the axial direction and seals the suction and pressure chamber of the gas jet pump against one another and seals the inside of the pump to the outside.

A particularly expedient embodiment of the invention, because it is particularly simple, is that the ring made of elastic material is a simple toroidal sealing ring ('O' ring).

In order to achieve a reliable fixing and also sealing effect by means of the ring made of elastic material, it is further proposed according to the invention that the inner edge of the flange of the housing and/or flange of the mixing nozzle holder be bevelled for forming the clamping groove. Both flange inner edges can be bevelled; but it is advisable for the sake of simple machining to limit the bevelling to one edge.

Instead of the bevelling of the inner edges of the flanges of the housing or the mixing nozzle holder, an annular recess can also be arranged at the inner edge on one of the flanges and the ring firmly clamped therein by means of the other flange, for maintaining tolerances and also the dimensioning of an annular recess is frequently simpler than the dimensional and tolerance maintenance with bevelling on housing edges.

In order to ensure precise axial fixing of the mixing nozzle relative to the fuel nozzle, a shoulder can be arranged in the housing in a further embodiment of the invention, against which shoulder abuts the mixing nozzle when the housing and the mixing nozzle holder are drawn together. At the same time, dimensioning and tolerancing the annular groove at the mixing nozzle and the corresponding machining or preparation of the inner edges of the flanges of the mixing nozzle holder and housing butting against one another can be adapted to one another in such a way that seating of the mixing nozzle against the shoulder in the housing is always guaranteed.

Finally, it is further proposed within the scope of the invention that the outside diameter of the mixing nozzle part between the annular groove and the mixing nozzle end pointing towards the fuel nozzle be made slightly smaller than in the adjoining part. This facilitates insertion of elastic rings into the annular groove at the mixing nozzle, especially when the material in this connection is less elastic, for example Teflon. This does not impair the axial fixing of the mixing nozzle, because the axial thrust acting on the mixing nozzle always points in the direction of the fuel nozzle because of the pressure differential between the space behind and the space in front of the mixing nozzle.

The invention is described by way of example with reference to the attached drawings, wherein:

FIG. 1 shows a longitudinal section through a gas jet pump, and

FIG. 1A shows a modified embodiment of the lower flange shown in FIG. 1.

Figure 3:
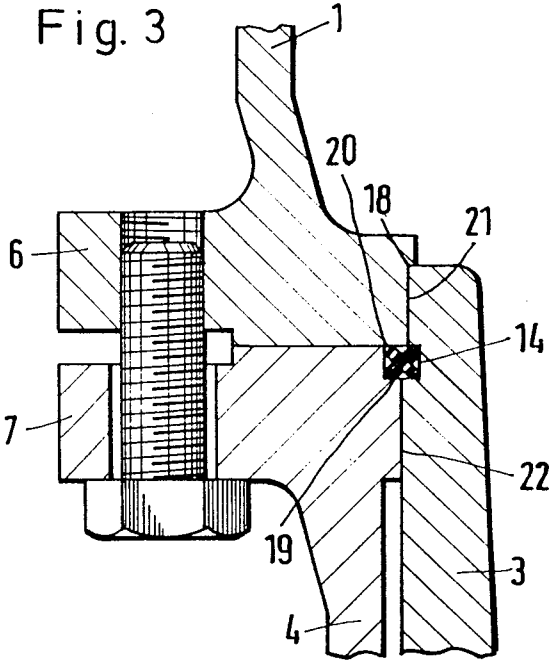
FIGS. 2 and 3 show two embodiments of the section indicated by the circle in FIG. 1.

The housing 1 contains the fuel nozzle 2 and the medium channels, namely a channel for the medium to be compressed leading from the flange connection 9 to the fuel nozzle enveloping chamber and a channel for the fuel medium leading from the connecting piece 11 to the fuel nozzle. The housing has a flange 6 for the connection of the mixing nozzle 3 or the mixing nozzle holder 4.

The mixing nozzle holder 4 has a flange 7 for connecting to the flange 6 of the housing by means of screws 5. It completely encloses the mixing nozzle, which is not necessary in all cases but has the advantage that the forces originating from the mixing and the pressure differentials need not be absorbed by the mixing nozzle. For the mixing nozzle, therefore, this embodiment permits the use of all suitable materials with respect to their chemical and physical stressing regardless of their strength. For example, the mixing nozzle can be made from a corrosion-resistant plastic or, with little outlay on material, from a high-grade material. In contrast, the mixing nozzle holder can be made of a lower grade material, as it does not come into contact with the feed or fuel medium.

When flanges 6 and 7 are referred to within the context of the invention, this is not intended to contain any limitation with respect to their design embodiment; every embodiment is possible in which the housing 1 and the mixing nozzle holder 4 are united in a transversely running parting plane by axial tension.

A bore 8 is made inside the flanges 6 and 7, in which bore 8 the mixing nozzle 3, with appropriately toleranced outer surface, is inserted in matching manner, by which means the mixing nozzle is aligned coaxially with the housing 1. Although the drawing shows the bore 8 in both the housing 1 and the mixing nozzle holder 4, if necessary this bore need only be made in the housing 1.

The outside diameter of the mixing nozzle 3 is made approximately uniformly cylindrical over its entire length. An annular groove 14 is recessed into the peripheral surface of the mixing nozzle in the area of the parting plane of the flanges 6, 7, into which annular groove 14 an elastic sealing ring 15 is inserted. The latter projects clearly beyond the outside diameter of the mixing nozzle 3.

In the example of FIG. 1, the inner edges 16 and 17 of the flanges 6 and 7 of the housing and the mixing nozzle holder are bevelled to form a clamping groove which is triangular in cross section. The cross section of the annular space, which is enclosed by the annular groove 14 and the bevelled surfaces 16 and 17 when the flanges 6 and 7 are directly seated on one another, is of such a size that it is expediently slightly larger than the cross section of the 'O' ring 15 inserted therein, with the latter being deformed in such a way that the required sealing pressure is ensured. The 'O' ring, because of its position in both the annular groove 14 on the mixing nozzle side and in the clamping groove on the housing side and formed by the bevelled surfaces 16 and 17 fixes the axial position of the mixing nozzle relative to the housing and seals the inside of the pump to the outside and the suction side of the pump relative to the pressure side of the pump.

The gas jet pump is closed off on the pressure side by the connecting piece 10, for which FIGS. 1 and 1A indicate different embodiment possibilities. In FIG. 1A an additional annular flange 12 is arranged on the thrust flange of the mixing nozzle holder, which annular flange 12 contains an elastic sealing ring 13 for sealing the pressure-side end of the mixing nozzle 3, whereas in FIG. 1 such a seal is dispensed with.

The medium to be fed flows into the pump through the connecting piece 9, whereas the fuel gas enters through the bore 11. Both leave the pump together through the pressure connecting piece 10 after the pump action has been initiated in known manner.

Figure 2:
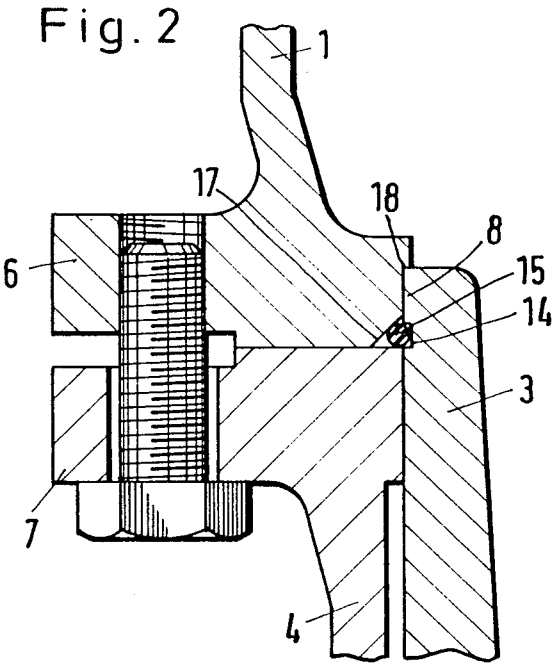

FIG. 2 shows an alternative embodiment of the area indicated in FIG. 1 by a chain-dotted circle. Whereas the annular groove 14 in the periphery of the mixing nozzle is rectangularly defined in the longitudinal section just as in the embodiment according to FIG. 1, the clamping groove is formed by a bevel 17 provided on one side on the flange 6 of the housing and by the flatly made end face of the flange 7 of the mixing nozzle holder. A shoulder 18 is provided in the bore 8 of the housing flange 6, by means of which shoulder 18 the mixing nozzle 3 is axially fixed in position. The arrangement of the annular groove 14 and the bevel 17 is selected in such a way that the mixing nozzle 3 sits against the shoulder 18 after assembly. The shoulder 18 supports the mixing nozzle against the forces which originate from the pressure differential between the suction side and the pressure side.

A further variant is shown in FIG. 3. Whereas the annular groove 14 is rectangularly defined in the outer surface of the mixing nozzle as in the other examples, the clamping groove is formed by a rectangularly defined recess 19 of the flange 7 of the mixing nozzle holder 4 on the one hand and the flatly made end face of the flange 6 of the housing on the other hand. A profile ring 20 is used as an elastic sealing ring. As in the example according to FIG. 2, a housing shoulder 18 is provided for axially fixing the mixing nozzle. In the area 21, the bores of the housing flange and the mixing nozzle peripheral surface interacting in matching manner with the housing flange are made with a slightly smaller diameter than in the area 22 of the bore formed in the flange 7 and the associated peripheral part of the mixing nozzle. Because of the smaller diameter in the area 21, the sealing ring 19 can be more easily incorporated into the annular groove 14.

We claim:

1. A gas jet pump having a housing (1) including a fuel inlet (11), a fuel nozzle (2) connected to the fuel inlet, and an entrained fluid inlet (9), a pump outlet (10), a mixing nozzle holder (4), a flange connection (5, 6, 7) between the housing and the mixing nozzle holder, and a mixing nozzle (3) between the fuel nozzle and the outlet, with a mounting being provided in the flange connection for the mixing nozzle, which mounting comprises a clamping groove formed by both flanges (6, 7) in their parting plane, wherein the holder for the mixing nozzle (3) comprises an annular groove (14) in the periphery of the mixing nozzle (3) and a ring (15) made of elastic material inserted into the annular groove (14), which ring (15) is enclosed under tension in the annular space formed by the annular groove (14) and the clamping groove, whereby the ring fixes the axial position of the mixing nozzle and provides a seal between the mixing nozzle and the housing, the mixing nozzle and the nozzle holder, and the housing and the nozzle holder.

2. A gas jet pump as claimed in claim 1, wherein the ring (15) made of elastic material is a toroidal sealing ring ('O' ring).

3. A gas jet pump as claimed in claim 1 or 2 wherein the inner edge of one of the flange (6) of the housing (1) or the flange (7) of the mixing nozzle holder (4) is beveled (17 or 16) for forming the clamping groove.

4. A gas jet pump as claimed in claim 1 or 2, wherein the clamping groove is formed by a recess (19) on one of the flange (6) of the housing (1) or the flange (7) of the mixing nozzle holder (4), cooperating with the other of the flange (6) of the housing or the flange (7) of the nozzle holder.

5. A gas jet pump as claimed in one of claims 1 or 2, wherein the mixing nozzle (3) sits against a shoulder (18) arranged in the housing (1).

6. A gas jet pump as claimed in one of claims 1 or 2, wherein the portion of the mixing nozzle (3) between the annular groove (14) and the mixing nozzle end pointing towards the fuel nozzle (2) has a smaller outside diameter (21) than the portion of the mixing nozzle adjacent the annular groove in a direction away from the fuel nozzle.

7. A gas jet pump as claimed in claim 1 or 2 wherein the inner edge of the flange (6) of the housing (1) and the flange (7) of the mixing nozzle holder (4) are beveled (16, 17) for forming the clamping groove.

* * * * *